US006718793B2

(12) United States Patent
Lee

(10) Patent No.: US 6,718,793 B2
(45) Date of Patent: Apr. 13, 2004

(54) REFRIGERATOR INCORPORATING CONDENSER FUNCTIONING AS BACKCOVER

(75) Inventor: Sang Wook Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/186,667

(22) Filed: Jul. 2, 2002

(65) Prior Publication Data

US 2003/0005720 A1 Jan. 9, 2003

(30) Foreign Application Priority Data

Jul. 7, 2001 (KR) ..... 2001/40648

(51) Int. Cl.[7] ..... F25D 19/00
(52) U.S. Cl. ..... 62/453; 62/440
(58) Field of Search ..... 62/453, 428, 452, 62/508, 404, 407, 408, 440

(56) References Cited

U.S. PATENT DOCUMENTS 2,444,667 A * 7/1948 Philipp ..... 62/89
4,355,521 A * 10/1982 Tsai ..... 62/196
4,527,624 A * 7/1985 Nishida et al. ..... 165/184
4,637,222 A * 1/1987 Fujiwara et al. ..... 62/244
4,891,952 A * 1/1990 Yoshikawa et al. ..... 62/199
4,989,252 A * 1/1991 Nakanishi et al. ..... 381/71
5,123,258 A * 6/1992 Brown et al. ..... 62/244
5,374,118 A * 12/1994 Kruck et al. ..... 312/407
5,666,817 A * 9/1997 Schulak et al. ..... 62/185
5,782,106 A * 7/1998 Park ..... 62/452
5,881,567 A * 3/1999 Junge et al. ..... 62/428
6,058,731 A * 5/2000 Byczynski et al. ..... 62/344

* cited by examiner

*Primary Examiner*—Melvin Jones

(74) *Attorney, Agent, or Firm*—Fleshner & Kim, LLP

(57) ABSTRACT

Disclosed is a refrigerator incorporating a condenser functioning as a backcover. The condenser is provided in one portion of the outer periphery of a machine room in a lower portion of the refrigerator while the machine is closed in other portions of the outer periphery so that air flow to/from the machine room is enabled only through the condenser to enhance cooling efficient and thus condensing efficient.

27 Claims, 5 Drawing Sheets

REFRIGERATOR INCORPORATING CONDENSER FUNCTIONING AS BACKCOVER

BACKGROUND OF THE INVENTION

1. Field of the Invention

The present invention relates to a refrigerator, in particular, which incorporates a condenser functioning as a backcover of a machine room so as to enhance condensing effect.

2. Description of the Related Art

As well known to those skilled in the art, various types of refrigerators are used to freeze or refrigerate foods.

FIG. 1 is a longitudinal sectional view of a general refrigerator.

Referring to FIG. 1, the refrigerator comprises a housing 10 defined by an internal receiving space divided into a freezing chamber 101 and a refrigerator chamber 102, freezing and refrigerating chamber doors 12 mounted to one side of the housing 10 for opening/closing the freezing chamber 101 and refrigerating chamber 102 and a number of devices including a compressor 20, a condenser 30, an expander (not shown) and an evaporator 40 for generating cold air in a cooling cycle.

Describing the operation of the refrigerator as set forth above, gaseous refrigerant in a low temperature and pressure is compressed into a high temperature and pressure by the compressor 20. The compressed gaseous refrigerant in a high temperature and pressure is converted into a high pressure liquid as cooled and condensed while passing through the condenser 30. The high pressure liquid refrigerant loses its temperature and pressure while passing through the expander (not shown). In succession, the refrigerant is transformed into a low temperature and pressure gas absorbing heat from surroundings to cool the same.

Then, air cooled by the evaporator 40 is circulated into the freezing chamber 101 and the refrigerating chamber 102 owing to operation of a blowing fan 50 installed in an evaporator room 103 to lower the temperature of the freezing chamber 101 and the refrigerating chamber 102.

In the meantime, the condenser 30 is generally used as a fin tube-type condenser comprising a refrigerant pipe 32 and a number of heat-radiating fins 34. The refrigerant pipe 32 is made of metal and continuously bent into a kind of multi-layered structure. The heat-radiating fins 34 are arranged in parallel with a certain interval, attached to the refrigerant pipe 32 via welding, and mounted in the shape of a thin panel apparently crossing said bent refrigerant pipe 32.

Further, the refrigerator is generally provided in the vicinity of the condenser 30 with a cooling fan for assisting efficient heat exchange due to forced convection.

FIG. 2 is a perspective view illustrating the machine room in a lower portion of the refrigerator.

As shown in FIG. 2, those devices generating heat or operation noise of the devices executing the cooling cycle are installed in the machine room 104, and they include the condenser 30, the compressor 20 and the cooling fan 60 for the condenser 30.

In the meantime, the machine room 104 is provided in a rear lower portion of the refrigerator separated from a refrigerator body so that the heat from the compressor 20 and the condenser does not transfer to the freezing and refrigerating chambers 101 and 102 or the noise may not spread.

A general small or medium-sized refrigerator generates a large amount of heat owing to the operation features of the compressor 20 and the condenser 30 so that the rear part of the machine room 104 has an opened structure to allow an effective heat-radiating operation.

In a large-sized refrigerator, however, the cooling fan 60 and the compressor 20 are adapted to have a large capacity thereby increasing the operation noise so that a backcover 70 is installed to block an opened side of the machine room 104 so as to enhance sound-proofing effect.

The backcover 70 is a kind of panel member provided with a number of ventilation louvers 701, and detachably mounted to the rear lower end of the housing 10 via screwing and so on.

According to the related art as set forth above, the backcover 70 can promote the marketability of the refrigerator since it blocks and reduces the operation noise from the compressor 20 and the cooling fan 60 in use for the condenser.

In the refrigerator adopting the backcover 70, however, the heat exchange efficiency of the condenser 30 is disadvantageously lower than in a refrigerator without the backcover 70 since air does not efficiently flow inside/outside the machine room 104 due to the backcover 70.

SUMMARY OF THE INVENTION

Accordingly, the present invention has been made to effectively solve the foregoing problems and it is an object of the present invention to provide a refrigerator comprising a housing having a freezing chamber and/or a refrigerating chamber, a door for opening/closing the freezing chamber and/or the refrigerating chamber, a compressor provided in a machine room in a lower portion of the housing, a cooling fan placed in the opposite of the compressor in the machine room, and a condenser with both ends respectively connected to the compressor and an evaporator for cooling refrigerant and having a refrigerant pipe portion and a heat-radiating fin portion configured as a panel for covering a portion of the outer periphery of the machine room to function as a backcover.

According to an aspect of the invention to obtain the above object, it is provided a refrigerator comprising: a housing having a freezing chamber and/or a refrigerating chamber; a door for opening/closing the freezing chamber and/or the refrigerating chamber; a compressor placed at one side of a machine room in a lower portion of the housing; a cooling fan provided in a central portion of the machine room for discharging air to a direction opposite to the position where the compressor is placed; and a condenser with both ends coupled to the compressor and an evaporator for cooling refrigerant and having a refrigerant pipe portion and a heat-radiating fin portion configured as a panel for covering a portion of the outer periphery of the machine room to function as a backcover.

In the refrigerator of the invention, the machine room is closed in the outer periphery except for the portion where the condenser is placed.

The condenser functioning as a backcover is made of plastic as set forth above to enhance condensing efficiency as an effect.

Further, a receiving space is enlarged in the refrigerator to increase the quantity of foods receivable in the refrigerator thereby enhancing the marketability of the refrigerator.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 3:
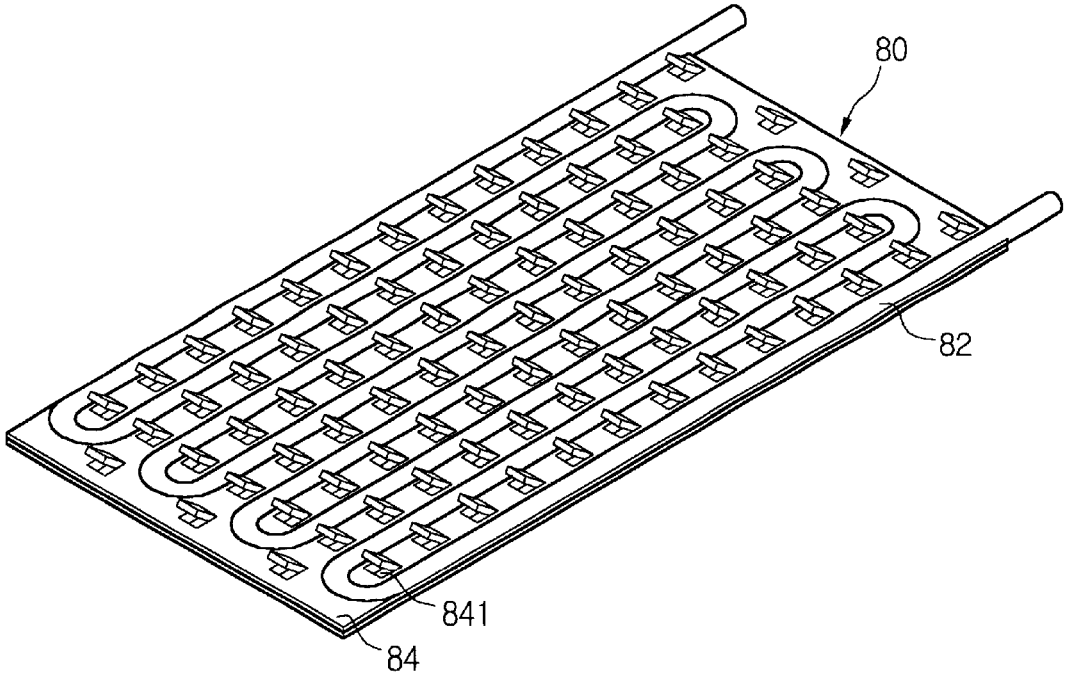
FIG. 3 is a perspective view of a condenser functioning as a backcover according to the invention.
Figure 4:
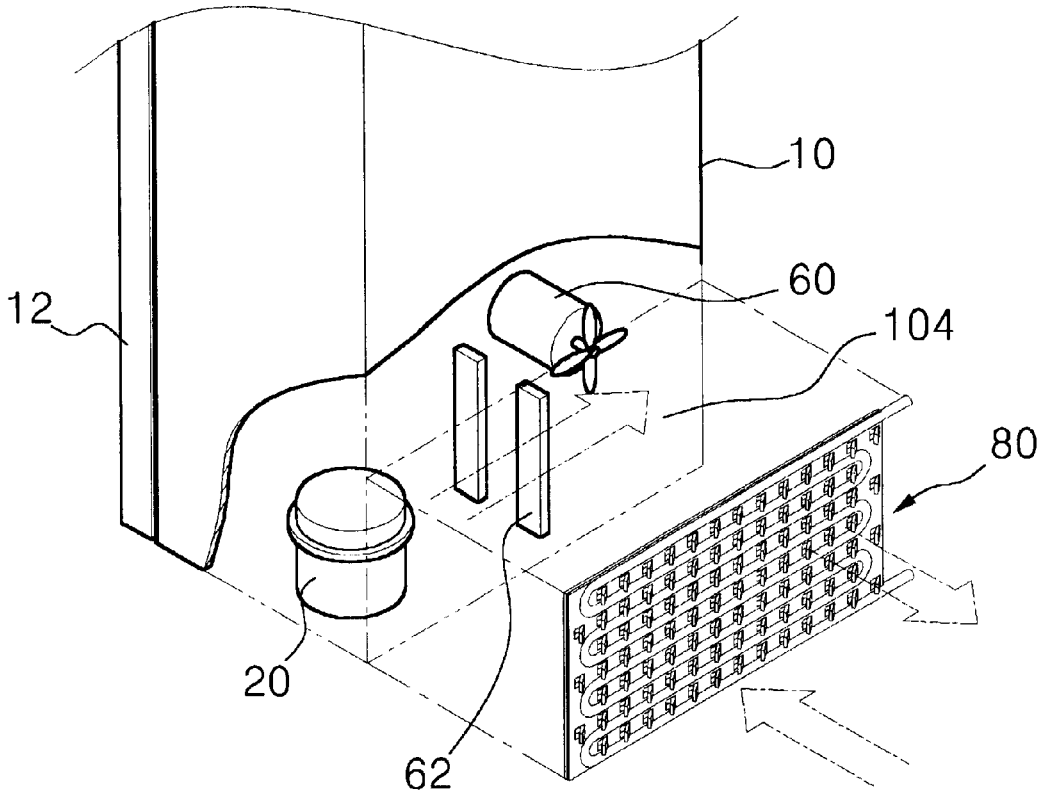
FIG. 4 illustrates a machine room of a refrigerator according to the invention.

The following detailed description will disclose a preferred embodiment of the present invention in reference to FIGS. 3 and 4, in which the same reference numerals are used to designate the same or similar components as in the conventional art.

FIG. 3 is a perspective view of a condenser functioning as a backcover according to the invention.

Referring to FIG. 3, the condenser 80 functioning as a backcover according to an aspect of the invention comprises a refrigerant pipe portion 82 with a plurality of refrigerant pipes through which refrigerant flows and a heat-radiating fin portion 84 connecting the refrigerant pipe portion 82.

The heat-radiating fin portion 84 of the condenser 80 is provided with a plurality of louvers 841 capable of ensuring efficient ventilation operation while muffling noise. The louvers 841 not only contribute to the efficient ventilation of a machine room 104 but also function as fins by themselves to enhance the cooling efficiency of the condenser 80. Other parts except for the condenser 80 are so closed to discharge air only through the condenser 80 thereby further enhancing the efficiency of the condenser 80.

Further, the condenser 80 is mounted to cover an opened side of the machine room 104 thereby also performing the role of a backcover 70 (refer to FIG. 4) which restricts discharge of noise.

The refrigerant pipe portion 82 and the heat-radiating portion 84 can be made of any material regardless of plastic or metal. Further, both of the refrigerant pipe portion 82 and the heat-radiating portion 82 can be integrally formed into a single piece.

FIG. 4 illustrates a machine room of a refrigerator according to the invention.

Referring to FIG. 4, the machine room 104 is provided with a cooling fan 60 used for the condenser 80, in which the cooling fan 60 is disposed to blow air toward the condenser 80, that is, toward the outside of the refrigerator. The compressor 20 is installed at a certain interval from the cooling fan 60. An air dam 62 is provided to partially block an internal space of the machine room 104 between the compressor 20 and the blowing fan 60. The condenser 80 is generally provided in the rear of the machine room 104.

The following discussion will more specifically describe the direction of air flown by the air dam 62 and the cooling fan 60.

The internal space of the machine room 104 is halved into the cooling fan 60 side and the compressor 20 side substantially about the air dam 62. In operation of the blowing fan 60, the external air is introduced into the compressor 20 side, flows through the air dam 62 into the cooling fan 60 side, and then is discharged out of the cooling fan 60 side. The machine room 104 is closed as a whole and allows air flow only through the condenser 80 so that all of the air introduced into the compressor 20 side and discharged from the cooling fan 60 necessarily passes through the condenser 80.

Based upon the air dam 62, one part of the condenser 80 (the compressor side) is cooled by the air introduced into the machine room 104, the other part of the condenser 80 (the cooling fan side) is cooled by the air discharged from the machine room 104.

That is to say, since the air discharged from the machine room 104 is already heated while primarily passing through the one part of the condenser 80 (the compressor side), it can be understood that the condensing operation has low efficiency in the other part of the condenser 80 contacting with the space of the machine room 104 in the side of the cooling fan 60.

Figure 1:
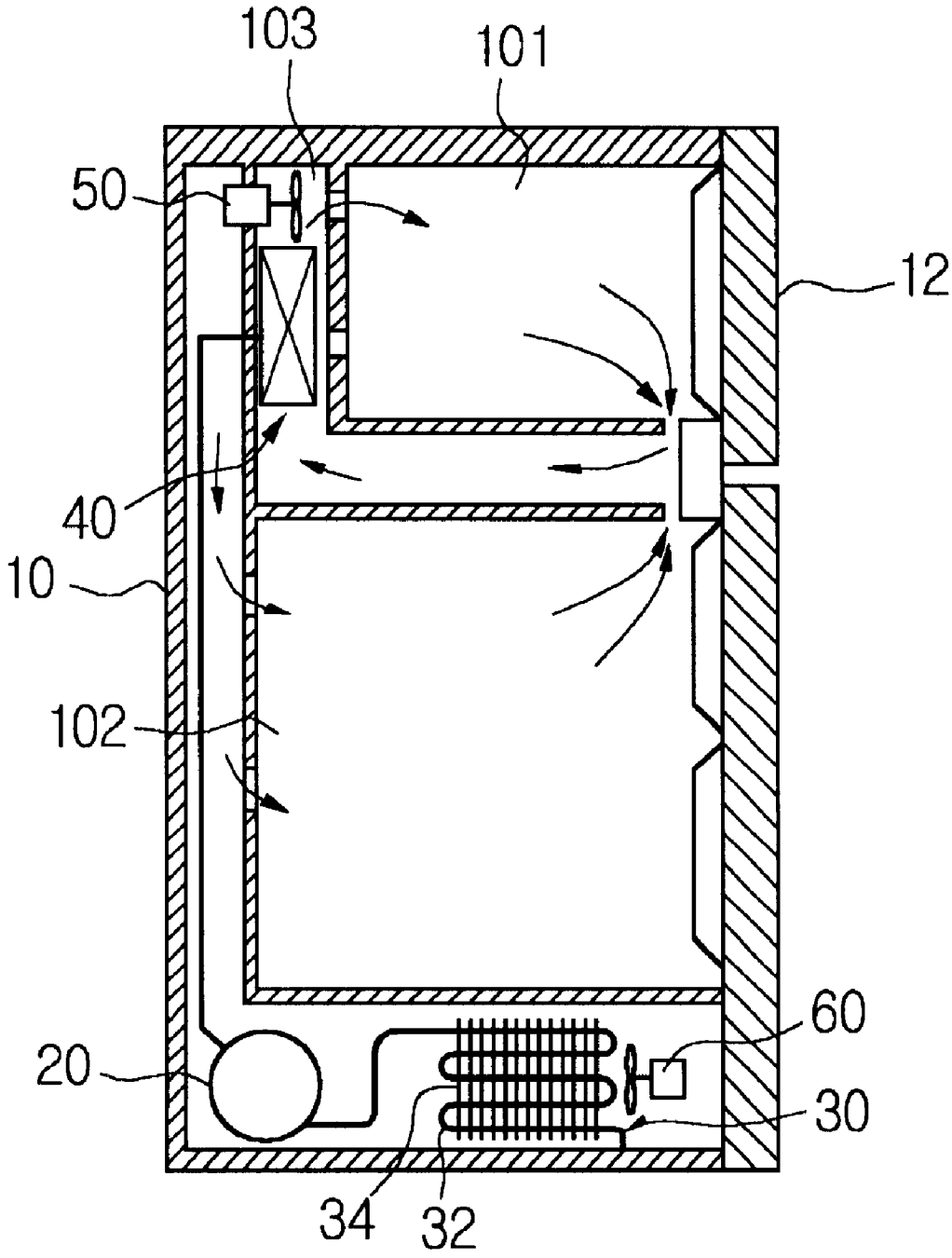
FIG.1 (BACKGROUND ART)
FIG. 1 is a longitudinal sectional view of a general refrigerator.

However, according to this embodiment as set forth above, the condenser 80 has a panel-shaped configuration which is wide in heat-radiating area and exposed out of the machine room 104 resultantly maintaining high heat exchange efficiency compared to the conventional tube-type condenser 30 (refer to FIG. 1).

The air dam 62 is not an essential component for implementing the invention, and the invention can provide another embodiment with a configuration where the air dam 62 is excluded.

Figure 5:
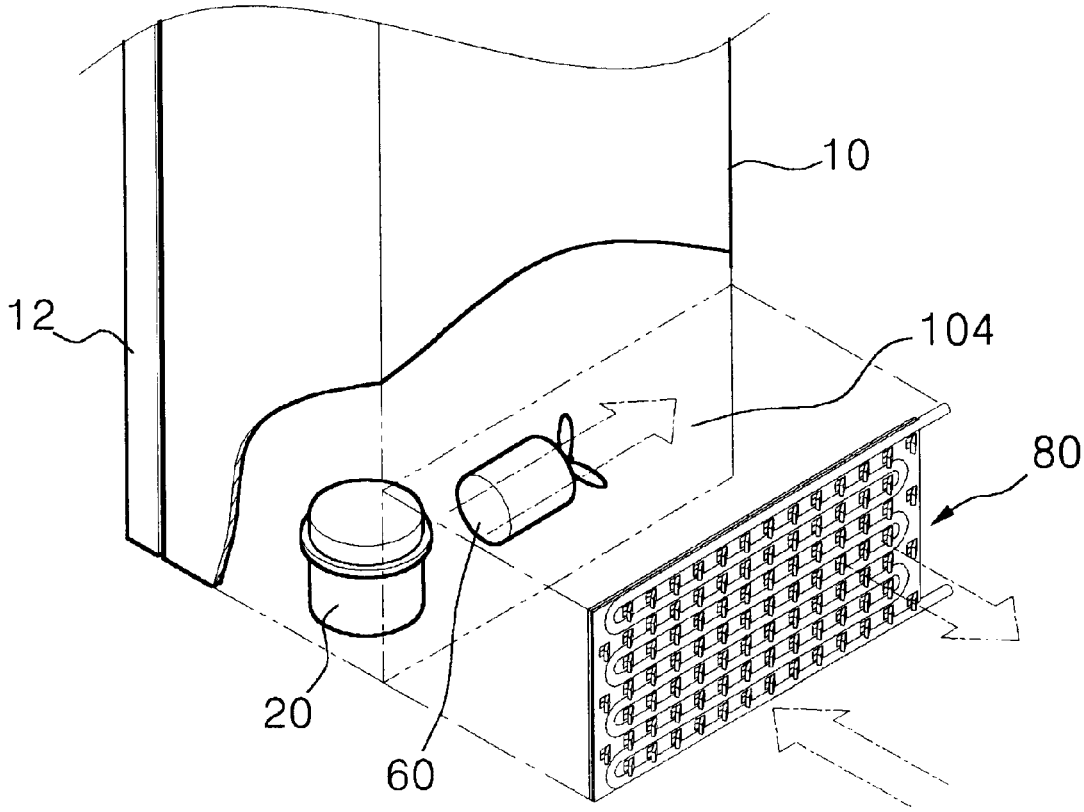
FIG. 5 illustrates another embodiment of the invention.

FIG. 5 illustrates another embodiment of the invention.

Referring to FIG. 5, the another embodiment of the invention comprises main components such as a compressor 20 biased to one side in a machine room 104, a cooling fan 60 placed in a substantially central position of the machine room 104 at a certain distance from the compressor 20 for blowing cool air away from the compressor 20 and a condenser 80 covering the rear portion of the machine room 104.

In the meantime, the compressor 80 has the same configuration and structure as the condenser described in reference to FIGS. 3 and 4. However, according to features of this embodiment, the cooling fan 60 is installed substantially in the center of the machine room 104 and also blows the air in a direction opposite to the installed position of the compressor 20.

Similar to the first embodiment of the invention, the machine room 104 is closed in all sides except for the condenser 80 so that the air flow between the inner and outer space of the machine room can be carried out only through the condenser 80.

Describing the internal operation within the machine room 104 having the above configuration, the compressor 20 sucks in the air toward the condenser 80 and ejects the air toward the cooling fan 60 while the cooling fan 60 sucks in the air from the compressor 20 side and ejects the air to the opposite direction. The air ejected from the cooling fan 60 is blocked by the side wall of the machine room and then discharged through the condenser 80. That is to say, the inlet side and the discharge side of air are determined in the condenser 80.

Figure 2:
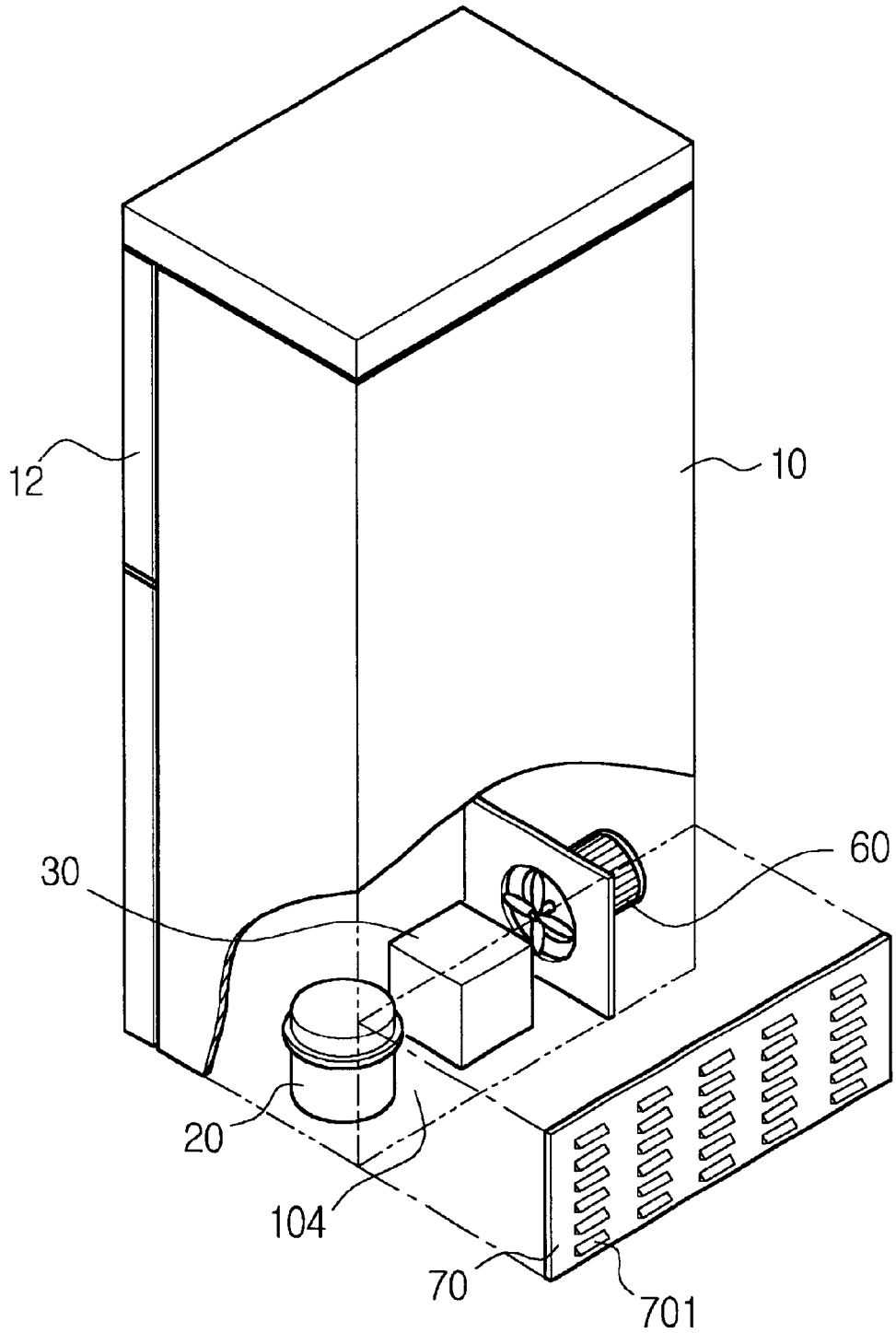
FIG. 2 (BACKGROUND ART)
FIG. 2 illustrates a machine room in a lower portion of a general refrigerator.

According to the embodiments of the invention, the condenser 80 is mounted in such a structure for covering the opened rear side of the machine room 104 thereby maintaining the noise muffling operation which is carried by the conventional backcover 70 (refer to FIG. 2).

Further, any additional space is not required for mounting the condenser 80 within the machine room 104 so that other components can be placed in an inner space of the machine room 104 as much as any space that would be otherwise occupied by the condenser 80.

Preferably, a receiving space is enlarged in the refrigerator as much as the machine room is reduced in volume resultantly increasing the quantity of foods receivable in the refrigerator.

Further, the condenser 80 has the panel-shaped configuration exposed out of the refrigerator to enlarge the cooling surface that can contact with the air thereby advantageously enhancing the efficiency of the condenser.

What is claimed is:

1. A refrigerator comprising:

a housing having a receiving space and a machine room;

a door mounted to one side of said housing for opening/closing said receiving space;

a compressor in said machine room: and a condenser, wherein said condenser is integrally provided with a refrigerant pipe portion; and wherein said condenser is integrated into a back panel over an opened portion of the outer periphery of a machine room.

2. The refrigerator according to claim 1, further comprising an air dam in a center section of said machine room thus dividing said machine room into two portions, wherein said compressor is placed in one side of said machine room, and a cooling fan is placed in the other side opposed to said compressor, wherein said cooling fan forces air in a direction approximately perpendicular to the air dam.

3. The refrigerator according to claim 1, where said back panel includes a plurality of louvers located between portions of the refrigerant pipe portion of said condenser.

4. The refrigerator according to claim 1, wherein said refrigerant pipe portion and a plurality of louvers are coplanar with said back panel.

5. The refrigerator of claim 1, wherein said machine room is below the receiving space of the housing, and wherein said back panel is located on a side of the machine room, which is on a bottom portion of the refrigerator, opposite the side of the refrigerator with the door mounted thereon.

6. The refrigerator of claim 1, wherein said refrigerant pipe portion uniformly covers the back panel.

7. The refrigerator of claim 1, wherein said condenser integrally includes a noise muffling panel and wherein said machine room is closed in the outer periphery except for the portion where said condenser is placed.

8. A refrigerator comprising:

a housing having at least one chamber;

a door opening/closing said at least one chamber a machine room located near the at least one chamber;

a compressor provided in said machine room;

a cooling fan positioned opposite to said compressor in said machine room; and a condenser connected to said compressor having a refrigerant pipe portion integrally formed in a back panel of the refrigerator covering a portion of the outer periphery of said machine room at a height approximately parallel to the compressor and the cooling fan.

9. The refrigerator according to claim 8, further comprising an air dam between said compressor and said cooling fan, wherein said cooling fan faces the condenser and the back panel.

10. The refrigerator according to claim 8, wherein said condenser includes a noise muffling panel.

11. The refrigerator according to claim 8, wherein said machine room is closed in the outer periphery except for the portion where said condenser is placed.

12. The refrigerator according to claim 8, where said back panel includes a plurality of louvers located between portions of the refrigerant pipe portion of said condenser.

13. The refrigerator according to claim 8, wherein said refrigerant pipe portion and a plurality of louvers are coplanar with said back panel.

14. The refrigerator of claim 8, wherein said refrigerant pipe portion uniformly covers the back panel.

15. A refrigerator comprising:

a housing having at least one chamber;

a door for opening/closing said at least one chamber;

a compressor placed at one side of a machine room in a portion of said housing near the at least one chamber;

a cooling fan provided in said machine room; and a condenser coupled to said compressor having a refrigerant pipe portion integrated into a back panel covering a portion of the outer periphery of said machine room, wherein said back panel includes a plurality of louvers located between portions of the refrigerant pipe portion of said condenser.

16. The refrigerator according to claim 15, wherein said refrigerant pipe portion and a plurality of louvers are coplanar with said back panel.

17. The refrigerator according to claim 15, further comprising an air dam in a center section of said machine room thus dividing said machine room into two portions, wherein said compressor is placed in one side of said machine room, and said cooling fan is placed in the other side opposed to said compressor, wherein said cooling fan forces air in a direction approximately perpendicular to the air dam.

18. The refrigerator of claim 15, wherein said machine room is below the at least one chamber, and wherein said back panel is located on a side of the machine room which is on a bottom portion of the refrigerator, opposite the side of the refrigerator with the door mounted thereon.

19. The refrigerator of claim 15, wherein said refrigerant pipe portion uniformly covers the back panel.

20. The refrigerator of claim 15, wherein said condenser integrally includes a noise muffling panel and wherein said machine room is closed in the outer periphery except for the portion where said condenser is placed.

21. A back panel for a home appliance, comprising:

louvers formed in the back panel; and a condenser integrally formed in the back panel.

22. The back panel according to claim 21, further comprising an air dam in a center section of a machine room thus dividing said machine room into two portions, wherein a compressor is placed in one side of said machine room, and a cooling fan is placed in the other side opposed to said compressor, wherein said cooling fan forces air in a direction approximately perpendicular to the air dam.

23. The back panel according to claim 21, where said back panel includes a plurality of louvers located between portions of a refrigerant pipe portion of said condenser.

24. The back panel according to claim 21, wherein said refrigerant pipe portion and a plurality of louvers are coplanar with said back panel.

25. The back panel according to claim 21, wherein said machine room is below a receiving space of the housing, and wherein said back panel is located on a side of the machine room, which is on a bottom portion of a refrigerator.

26. The back panel according to claim 21, wherein a refrigerant pipe portion uniformly covers the back panel.

27. The back panel according to claim 21, wherein said condenser integrally includes a noise muffling panel, and wherein a machine room is closed in the outer periphery except for the portion where a condenser is placed.

* * * * *